US006669044B2

(12) United States Patent
Murakami et al.

(10) Patent No.: US 6,669,044 B2
(45) Date of Patent: Dec. 30, 2003

(54) FOLDABLE CONTAINER

(75) Inventors: Tetsuya Murakami, Gifu (JP); Hidetoshi Yamaguchi, Gifu (JP)

(73) Assignee: Gifu Plastic Kogyo Kabushikigaisha, Gifu (JP)

( * ) Notice: Subject to any disclaimer, the term of this patent is extended or adjusted under 35 U.S.C. 154(b) by 0 days.

(21) Appl. No.: 09/822,350

(22) Filed: Apr. 2, 2001

(65) Prior Publication Data

US 2001/0027976 A1 Oct. 11, 2001

(30) Foreign Application Priority Data

Apr. 10, 2000 (JP) ..... 2000-108630

(51) Int. Cl.[7] ..... B65D 6/00
(52) U.S. Cl. ..... 220/6; 220/7
(58) Field of Search ..... 220/6, 7, 1.5

(56) References Cited

U.S. PATENT DOCUMENTS

| | | | | | |
|---|---|---|---|---|---|
| 3,874,546 | A | * | 4/1975 | Sanders et al. | 220/7 X |
| 4,062,467 | A | * | 12/1977 | Friedrich | 220/7 |
| 4,591,065 | A | * | 5/1986 | Foy | 220/7 |
| 4,960,223 | A | | 10/1990 | Chiang et al. | |
| 5,938,059 | A | * | 8/1999 | Luburic | 220/7 X |
| 6,209,742 | B1 | * | 4/2001 | Overholt et al. | 220/7 X |
| 6,293,418 | B1 | * | 9/2001 | Ogden et al. | 220/7 |

FOREIGN PATENT DOCUMENTS

| | | | |
|---|---|---|---|
| BE | 1010646 | A | 11/1998 |
| BE | 1010646 | A3 | 11/1998 |
| EP | 0 911 268 | A1 | 4/1999 |
| EP | 1 114 779 | A2 | 7/2001 |
| JP | 60-172645 | | 9/1985 |
| JP | 62-150321 | | 9/1987 |
| JP | 63-117725 | U | 7/1988 |
| JP | 2-108832 | | 8/1990 |
| JP | 6-72833 | | 10/1994 |
| JP | 9-165031 | | 6/1997 |
| JP | 11-502492 | A | 3/1999 |

OTHER PUBLICATIONS

French Search Report w/ English Translation.

* cited by examiner

*Primary Examiner*—Stephen Castellano
(74) *Attorney, Agent, or Firm*—Oliff & Berridge, PLC

(57) ABSTRACT

A foldable container comprises rotatably mounted side plates on the long sides of a bottom plate that opposed to each other and rotatably mounted side plates on the short sides of the bottom plate that also opposed each other. The foldable container is folded by folding down the pair of the short side side plates onto the pair of the long side side plates. The foldable container is assembled in the form of a box by raising the pair of short side side plates and then raising the pair of long side side plates. Both edge portions on the inner face of each raised short side side plate are supported by the long side side plate edge faces. A supporting protrusion is provided on edge portion of the inner face of the short side side plate. When the short side side plates are folded down, the supporting protrusions on each edge portion is fitted into concave portions provided in each long side edge portion of the bottom plate.

20 Claims, 17 Drawing Sheets

FOLDABLE CONTAINER

The disclosure of Japanese Patent Application No. 2000-108630 filed Apr. 10, 2000 including the specification, drawings and abstract is incorporated herein by reference in its entirety.

BACKGROUND OF THE INVENTION

1. Field of the Invention

The present invention relates to a foldable container.

2. Description of the Related Art

A foldable container has been well known, in which a side plate corresponding to a long side is mounted rotatably on each of long sides that are opposed to each other of a rectangular bottom plate and a side plate corresponding to a short side is mounted rotatably on each of short sides that are opposed to each other of the bottom plate. For example, Japanese Utility Model Laid-Open No. 63-117725 has disclosed this kind of foldable container. The foldable container disclosed in the Japanese Utility Model Application Laid-Open No. 63-117725 comprises, as shown in FIGS. 15A and 15B, side plates 2 on the long side mounted rotatably onto the long sides that are opposed to each other of a rectangular bottom plate and side plates 3 on the short side mounted rotatably on the short side that are opposed to each other. As shown in FIG. 15B, a pair of the side plates 2 on the long side are fallen onto a pair of the side plates 3 on the short side and as shown in FIG. 15A, after raising the pair of the side plates 2 on the long side, a pair of the side plates 3 on the short side are raised and then, the side plate 3 on the short side is brought into contact with supporting protrusions 4 provided on both ends of the side plate 2 on the long side so as to prevent the side plates 3 on the short side from falling outward, thereby the foldable container being assembled in the form of a box.

When an individual carries the foldable container assembled in the form of box with a storage object therein usually the individual carriers it as if he or she embraces the container with the both hands with a long side of its rectangular shape opposing his breast. In this case, both hands of the individual carrying the foldable container press the side plates 3 of both the short sides that are opposed to each other inward as indicated by arrows in FIG. 15A. Consequently, there is a problem that when the individual carries the foldable container up/down or to other place with the hands, the side plates 3 may fall down. Although latching the side plates 3 with a latching hook freely releasable so as to prevent the side plates from falling inward, if an individual carries this foldable container assembled in the form of box with the both hands as if the individual embraces it as described above, the latching condition may be released by a force applied to the side plates 3 on the short side by the both hands, so that the side plates 3 on the short side may fall inward.

Because the side plate 3 on the short side may fall inward when the individual carries the foldable container assembled in the form of box, the storage object may be damaged by the side plated 3 on the short side that are fallen inward or he has to raise the side plate 3 on the short side again, which is a troublesome work.

Further, when the foldable container is folded down, the supporting protrusions 4, provided on both end portions of the side plate 2 on the long side for preventing the side plate 3 on the short side from falling down, protrudes downward from the side plate 2 on the long side, so that the stacking height of the folded container is increased by an amount corresponding to the length of the protrusion downward of the supporting protrusion 4. This is one reason why the foldable container is bulky when it is folded down.

If stacking height of the foldable container is large when it is folded down, distribution cost is increased, which is a problem to be solved.

SUMMARY OF THE INVENTION

It is an object of the present invention to provide a foldable container, wherein when an individual carries the foldable container assembled in the form of a box with the both hands as if he or she embraces it, the side plate on the short side never falls down even if it is pressed by the arm of the carrier, the foldable container capable of maintaining the assembled condition in the form of box securely and ensuring a low stacking height when it is folded down.

According to a first aspect of the present invention, there is provided a foldable container comprising a rectangular bottom plate, side plates on the long sides of the bottom plate mounted rotatably on the long sides that are opposed to each other and side plates on the short sides of the bottom plate mounted rotatably on the short sides that are opposed to each other, wherein the foldable container is folded by falling a pair of the side plates on the short sides onto a pair of the side plates on the long sides fallen down and the foldable container is assembled in the form of a box by raising a pair of the side plates on the short sides and then raising a pair of the side plates on the long sides. supporting protrusions are provided on part of both end portions on an inner face of the side plate on the short side, wherein the supporting protrusions support the both end portions of the side plate on the long side when the side plates on the short sides are raised so as to prevent the side plates on the long sides from falling outward. Further, the supporting protrusions are fitted into concave portions provided in both end portions on the long sides of the bottom plate when the side plates on the short sides are fallen. With such a structure, the both end portions on the inner face of the raised side plate on the short side are supported by the both side end faces of the opposing side plate on the long side, so that the side plate on the short side never falls inward until the side plate on the long side is fallen down. As a result, even if a force trying to fall the side plate on the short side inward is applied by an arm when an individual carries the foldable container assembled in the form of box as if he or she embraces it with the both hands, it is possible to prevent the side plates on the short sides from falling down. Further, when the side plates are raised, the both end portions of the side plate on the long side are supported by the supporting protrusions provided on part of the both end portions on the inner face of the side plate on the short side, so as to prevent the side plate on the long side from falling outward. Further, although the supporting protrusions are protruded downward from the side plate on the short side, the supporting protrusions are fitted into the concave portions provided in the both end portions on the long side of the bottom plate when the side plates are fallen down. Consequently, the stacking height when the foldable container is folded can be suppressed to be small.

Preferably, the supporting protrusions may be fitted into the concave portions and supported by the concave portions when the side plates on the short sides are fallen. With such a structure, when the container is folded down, a load applied to the side plate on the short side is supported by the supporting protrusions, so that the folded condition can be maintained stable.

Preferably, the concave portion may be formed of a hole open upward and having a bottom. If the concave portion has the bottom, the supporting protrusion fitted into the concave portion can be supported by the bottom of the concave portion. By fitting the supporting protrusion into the concave portion formed of a hole open upward, the supporting protrusion is not exposed on a side face of the foldable container when it is folded down, so that other object never collides with the supporting protrusion.

Preferably, the concave portion may be formed of a hole open upward and downward. With such a structure, even if there is provided a concave portion in which the supporting protrusion is to be fitted, it is possible to keep water from being deposited in the concave portion. By fitting the supporting protrusion into the concave portion formed of a hole open upward and downward, the supporting protrusion is not exposed on the side face of the foldable container when it is folded down, so that other object never collides with the supporting protrusion.

Further, preferably, when the side plates on the short sides in pairs are fallen, another portion than the portion on which the supporting protrusions are provided on each of both end portions of the side plate on the short side may be supported by both end portions on the long sides of the bottom plate with the supporting protrusions being fitted into the concave portions provided in the both end portions on the long side of the bottom plate. With such a structure, in the folded condition, a load applied to the side plate on the short side can be supported by the other portion than the supporting protrusion, so that the folded condition can be maintained stable.

BRIEF DESCRIPTION OF THE DRAWINGS

FIGS. 5A and 5B are sectional views showing a condition in which the foldable container according to an embodiment of the present invention is folded while FIG. 5A is a sectional view taken along the line VA—VA in FIG. 6, and FIG. 5B is a sectional view taken along the line VB—VB in FIG. 6;

DETAILED DESCRIPTION OF THE PREFERRED EMBODIMENTS

Hereinafter, the preferred embodiments of the present invention will be described.

A side plate 2 of synthetic resin corresponding to a long side is mounted rotatably to each side of the long sides that are opposed to each other of a rectangular bottom plate 1 of synthetic resin. Further, a side plate 3 of synthetic resin corresponding to a short side is mounted rotatably to each side of the short sides that are opposed to each other of the bottom plate 1.

Figure 2:
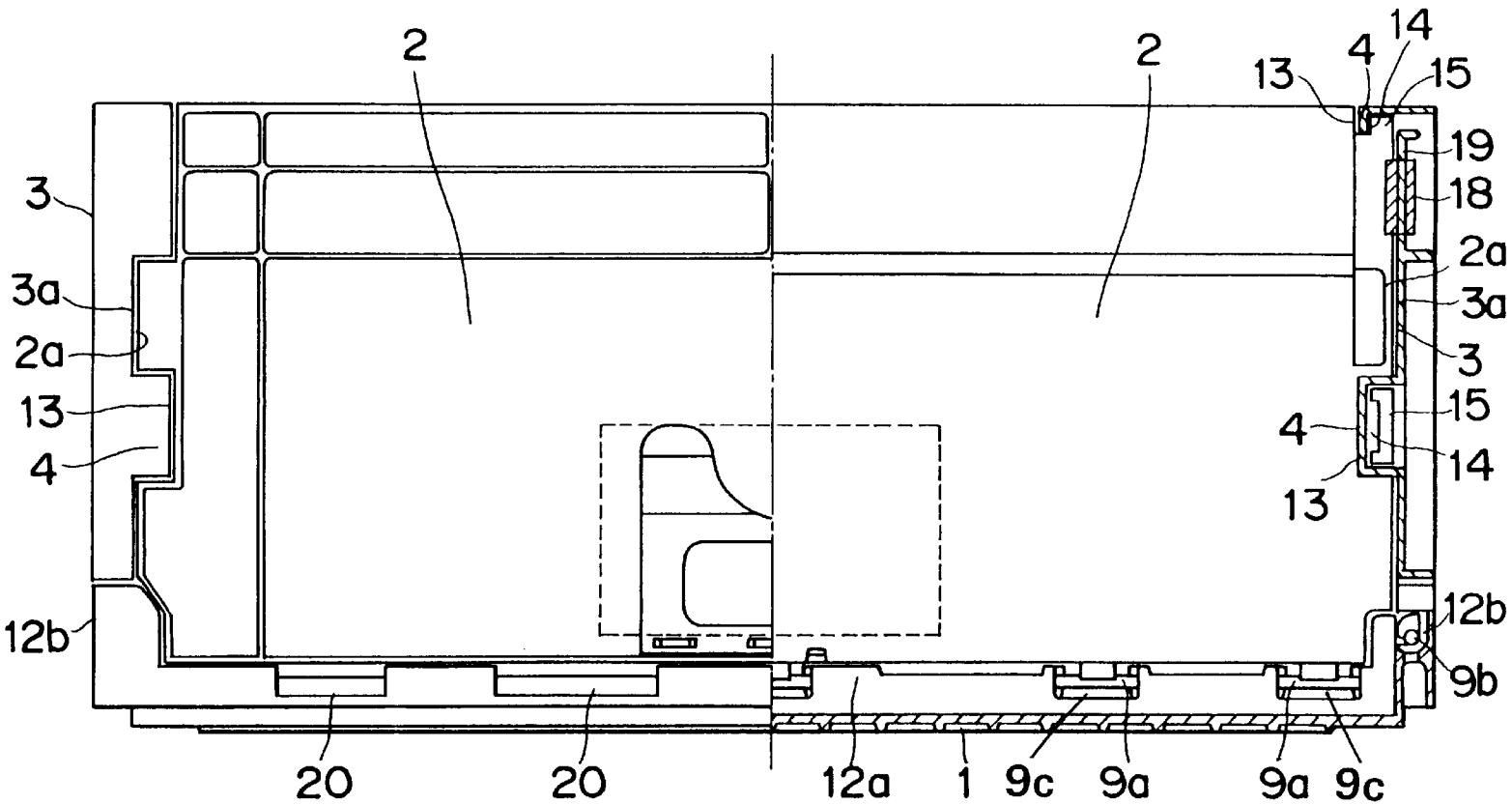
FIG. 2 is a front view showing a condition of the foldable container assembled in the form of a box while a half of the view is shown in section.
Figure 3:
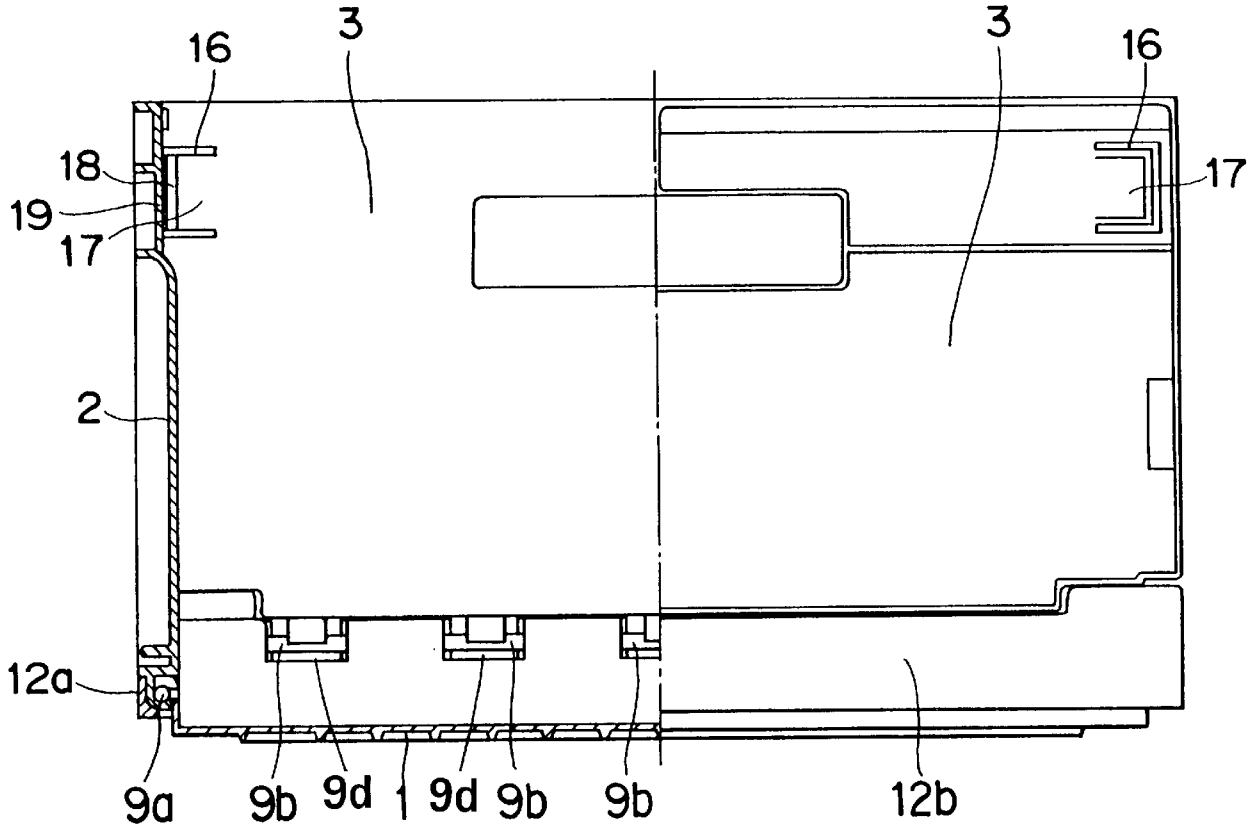
FIG. 3 is a side view showing a condition of the foldable container assembled in the form of a box while a half of the view is shown in section.

As shown in FIGS. 2 and 3, bottom end portions of the side plates 2 on the long side and the side plates 3 on the short side are mounted rotatably to the bottom plate 1 through lateral shaft portions 9*a* and 9*b*.

Here, the heights (height of the lateral shaft portions 9*a* and 9*a*) of respective journal portions of both the side plates 2 on the long side in pairs with respect to the bottom plate 1 are the same. Further, the heights (height of the lateral shaft portions 9*b* and 9*b*) of respective journal portions of both the side plates 3 on the short side in pairs with respect to the bottom plate 1 are the same. As shown in FIGS. 1, 2, 3, 4, 5, 8 and the like, the long side of a top face of the bottom plate 1 has rising protruded portion 12*a* and the lateral shaft portion 9*a* on the long side is located within a concave portion 9*c* in the rising protruded portion 12*a*. As shown in FIGS. 1, 2, 3, 4, 8 and the like, the short side of a top face of the bottom plate 1 has rising protruded portion 12*b* and the lateral shaft portion 9*b* on the short side is located within a concave portion in the rising protruded portion 12*b*.

The height of the journal position (height of the lateral shaft portions 9*b* and 9*b*) of the side plate 3 on the short side with respect to the bottom plate 1 and the height of the journal position (height of the lateral shaft portions 9*a* and 9*a*) of the side plate 2 on the long side with respect to the bottom plate 1 are different from each other. That is, the height of the journal position of the side plate 3 on the short side is set higher than that of the journal position of the side plate 2 on the long side. Upon folding, first, the side plates 2 on the long side in pairs are folded onto the bottom plate 1 and next, the side plates 3 on the short side in pairs are folded onto the side plates 2 on the long side. Upon assembly in the form of a box, first, the side plates 3 on the short side in pairs are raised and then, the side plates 2 on the long side in pairs are raised so as to assemble the container in the form of a box. By employing a structure in which the container is folded by falling a pair of the side plates 2 on the long side and then falling a pair of the side plate 3 on the short side thereon and the container is assembled by raising a pair of the side plates 3 on the short side and then raising a pair of the side plates 2 on the long side, both end portions 3*a* op an inner face of the raised side plate 3 on the short side oppose end face portion 2*a* of the raised side plate 2 on the long side so as to support the side plates 3 on the short side from falling inward.

Figure 10A:
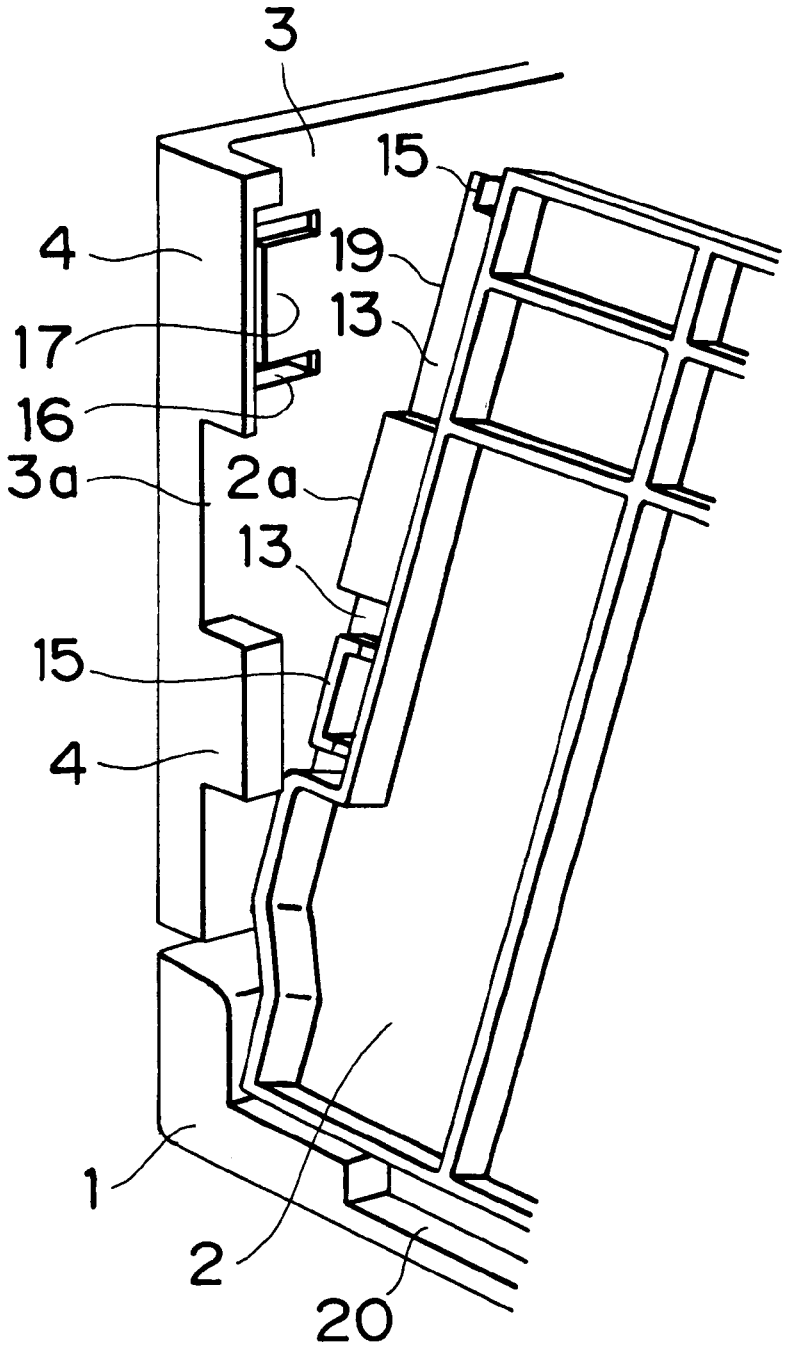
FIG. 10A is a perspective view showing a condition in which the side plate on a long side is being raised after the side plate on a short side is raised and FIG. 10B is a perspective view of an end portion of the raised side plate corresponding to the short side.
Figure 10B:
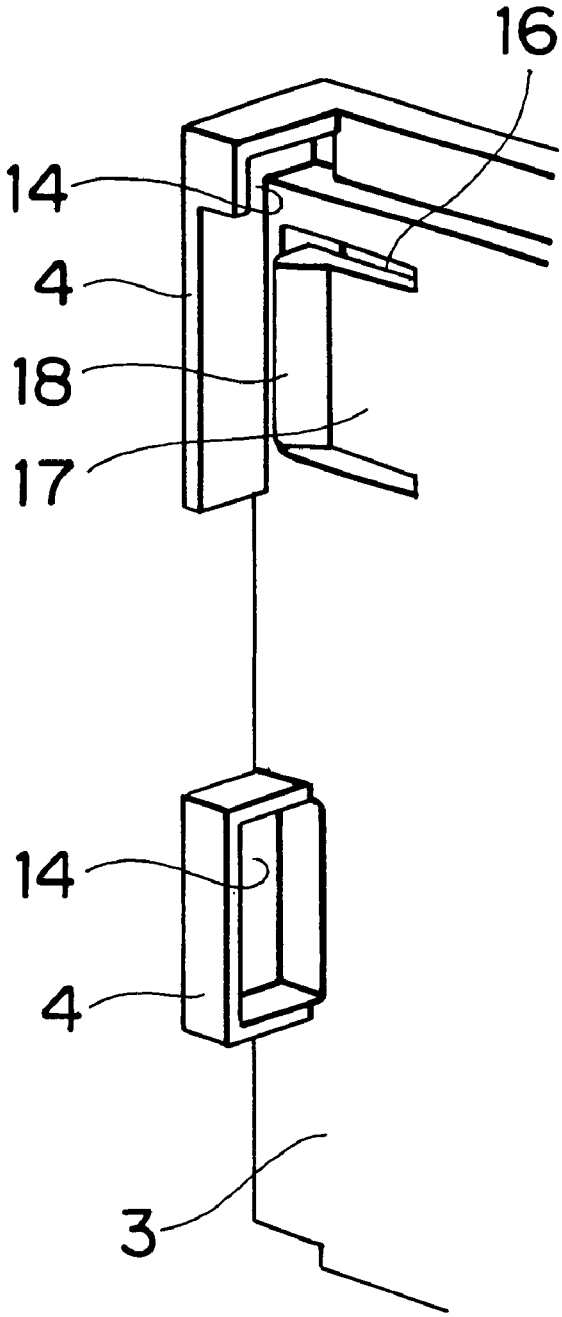

As stated above, part of both end portions 3*a* on an inner face of the raised side plate 3 on the short side opposing the end face portions 2*a* of the raised side plate 2 on the long side has a supporting protrusion 4 which supports both end portions of the raised side plate 2 on the long side so as to prevent the raised side plates 2 on the long side from falling outward. On the other hand, the end face portions 2*a* of the side plate 2 on the long side have concave portions 13 for engagement formed in its outside face and when assembled in the form of a box, the supporting protrusion 4 invades into each concave portion 13 so as to prevent the raised side plate 2 on the long side from falling outward by the supporting protrusion 4. As shown in FIGS. 2 and 10, the supporting protrusion 4 has a latching portion 14 and the concave portion 13 has a latched portion 15. When assembled in the form of a box, the supporting protrusions 4 invade into the concave portions 13 so that the latching portions 14 are fastened to the latched portions 15, so as to prevent the side plates 3 on the short side from falling outward. Therefore, according to this embodiment, the latching portion 14 and the latched portion 15 form short side outward fall preventing means for preventing the raised side plates 3 on the short side from falling outward.

As shown in FIG. 3, a generally U-shaped slit hole 16 is provided in part of each of both end portions of the side plate 3 on the short side and a portion surrounded by this slit hole 16 acts as an elastic piece 17 such that the elastic piece 17 has an engaging portion 18. On the other hand, each of the end face portions 2*a* of the side plates 2 on the long side has an engaged portion 19 which is engaged with the engaging portion 18 when they are raised. By engaging the raised engaging portion 18 with the raised engaged portions 19 elastically, the side plates 2 on the long side are prevented from falling inward. Therefore, according to this embodiment, the engaging portion 18 and the engaged portions 19 compose a long side inward fall preventing means for preventing the raised side plates on the long side from falling inward.

Figure 1:
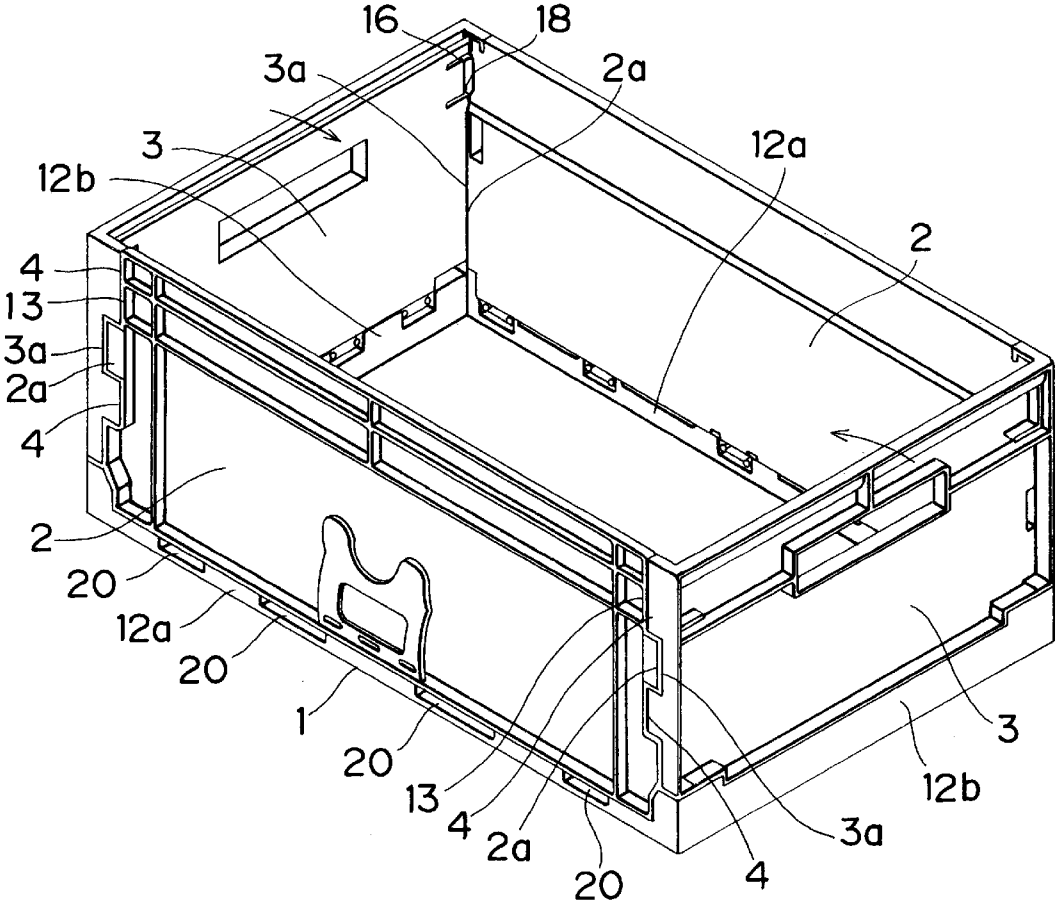
FIG. 1 is a perspective view showing a condition in which a foldable container of the present invention is assembled in the form of a box.
Figure 4:
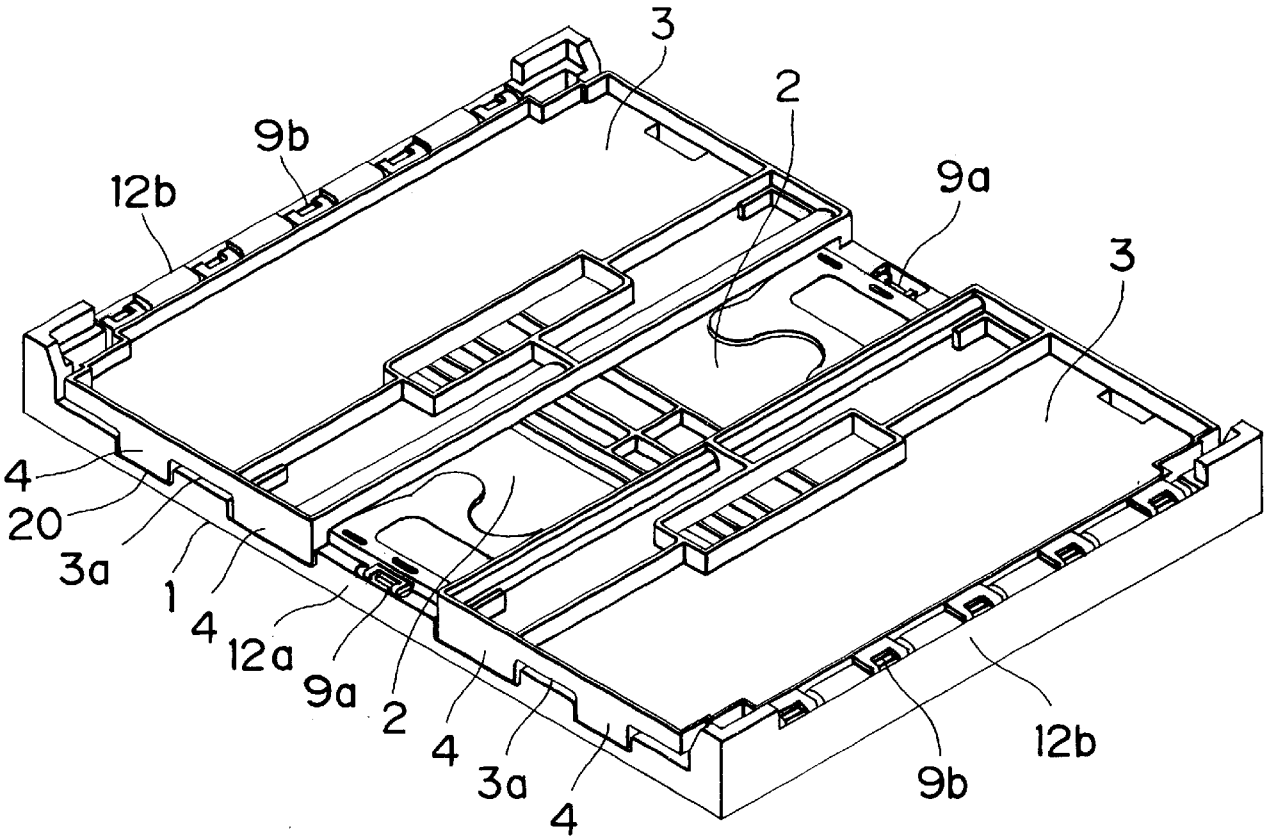
FIG. 4 is a perspective view showing a condition in which the same foldable container is folded.

As shown in FIGS. 1, 2 and 4, concave portions 20, into which the supporting protrusions 4 of the both end portions are fitted when the side plates 3 on the short side in pairs are fallen, are provided in both end portions on the long side of the top face of the bottom plate 1.

In using the foldable container having such a structure, this container contains a storage object in its assembled condition as shown in FIGS. 1 and 2 and is carried. When it is not used, this container is folded in a compact style and carried or stored.

When assembling the foldable container before use, first, both the side plates 3 on the short side are raised by rotating each and after that, the side plates 2 on the long side are raised by rotating it, so that this containing is assembled in the form of a box as shown in FIGS. 1, 2 and 3. When assembled in the form of a box, the both end portions 3*a* on the inner face of the side plate 3 on the short side oppose the end face portions 2*a* of the side plate 2 on the long side opposing the former so as to support the side plates 3 on the short side from falling down. Further, the supporting protrusions 4 are fitted into the concave portions 13 so that the side plates 2 on the long side are prevented from falling outward by the supporting protrusions 4. Further, the latching portions 14 are fastened to the latched portions 15 so as to prevent the side plates 3 on the short side from falling outward. Further, the engaging portions 18 elastically engage with the engaged portions 19 so as to prevent the side plates 2 on the long side from falling inward.

If an individual carries the foldable container assembled in the form of a box with a storage object therein as above stated, usually the individual carries it with a long side of the rectangle opposing his breast as if he or she embraces both the short sides with both hands. In this case, both hands of a person carrying the foldable container press the side plates 3 on both the short sides that are opposed to each other in a direction of falling the side plates inward as indicated by arrows in FIG. 1. However, according to the present invention, the both end portions 3*a* on the inner face of the raised side plates 3 on the short side are supported by the end face portions 2*a* of the side plates 2 on the long side that are opposed to the former, so that the side plates 3 on the short side are not fallen unless the side plates 2 on the long side are fallen. Thus, if a force trying to fall the side plates 3 on the short side is applied to the side plates 3 on the short side in pairs in the foldable container assembled in the form of a box when it is carried by a person as if the side plates 3 on the short side are held with the both hands, it is possible to prevent the side plates 3 on the short side from falling inward. Consequently, the side plates 3 on the short side never fall to destroy a storage object. They also eliminates the need of a processing for raising again the side plates 3 that have been fallen inward.

Figure 8:
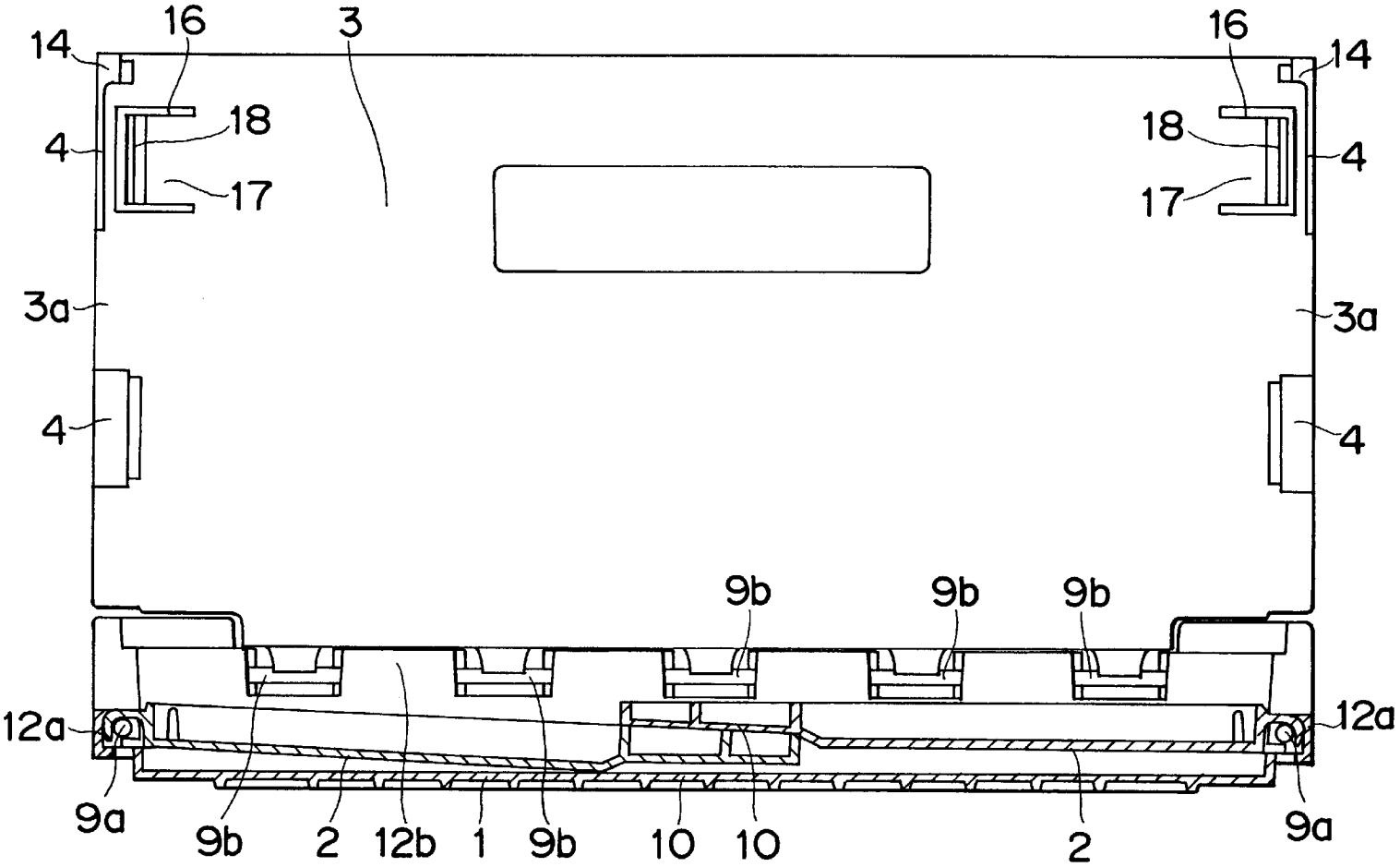
FIG. 8 is a sectional view showing a condition in which side plates on long sides are fallen while side plates on short sides are not fallen.
Figure 9:
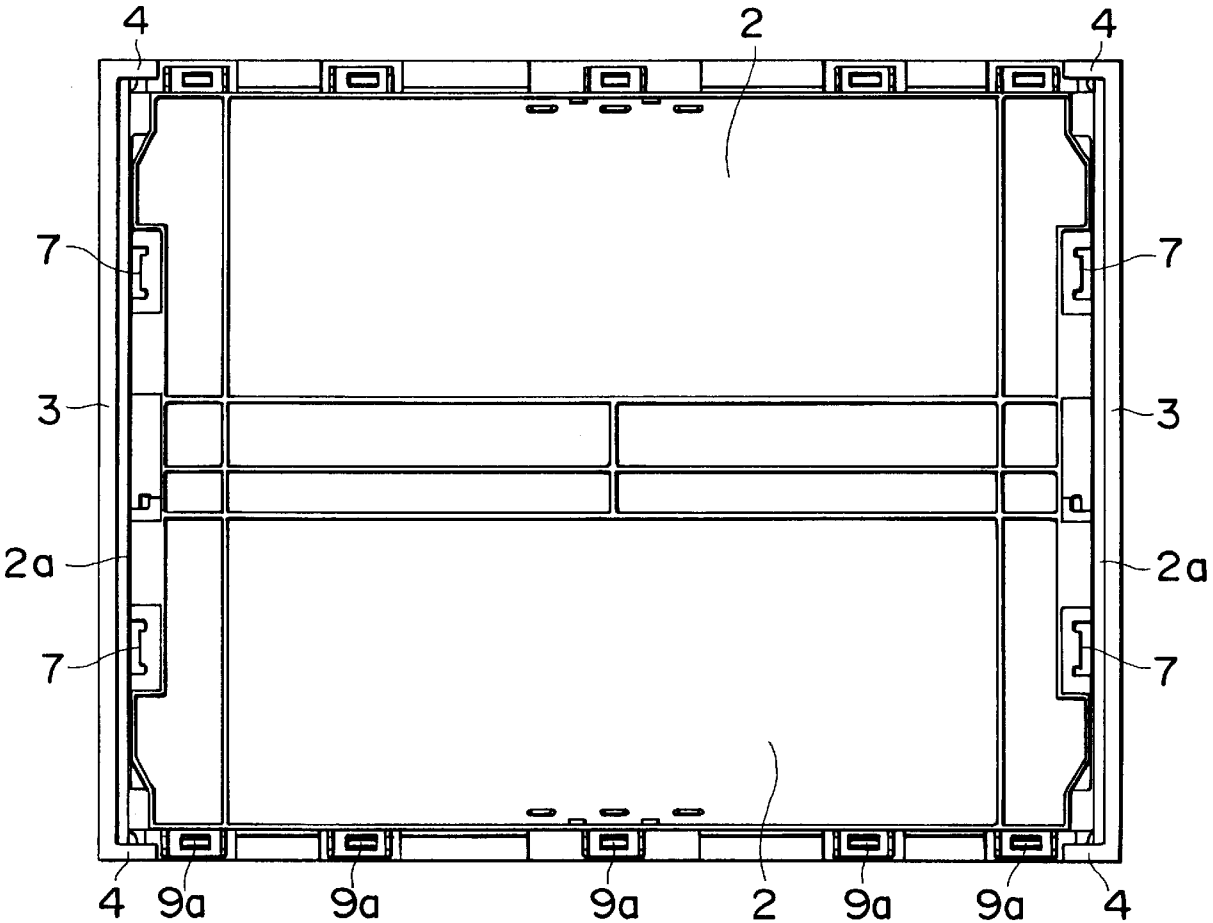
FIG. 9 is a plan view showing a condition in which side plates in pairs on long sides are fallen while side plates in pairs on short sides are not fallen.

On the other hand, if the foldable container is not used, the raised side plates 2 on the long side are pressed inward with a slightly strong force so as to release elastic engagement between the engaging portion 18 and the engaged portions 19. Then, the side plates 2 on the long side are fallen inward (FIGS. 8 and 9). After that, the side plates 3 on the short side are fallen, so that the container can be folded in a compact style as shown in FIG. 4.

This foldable container is so constructed that the supporting protrusions 4 provided on both end portions of the side plate 3 on the short side are fitted into the concave portions 20 provided on both end portions corresponding to the long side of the bottom plate 1. As a result, although the supporting protrusions 4 protrude downward relative to the side plate 3 on the short side when the side plates 3 on the short side are fallen, the supporting protrusions 4 are fitted into the concave portions 20 provided in both end portions corresponding to the long side of the bottom plate 1, so that the height of the folded container can be reduced.

Figure 7A:
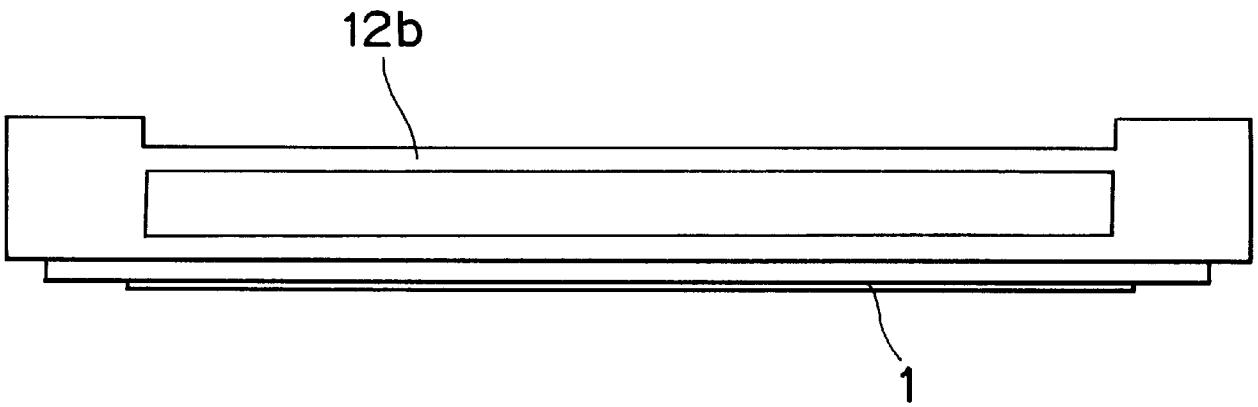
FIG. 7A is a side view showing the same condition and FIG. 7B is a front view of the same condition.
Figure 7B:
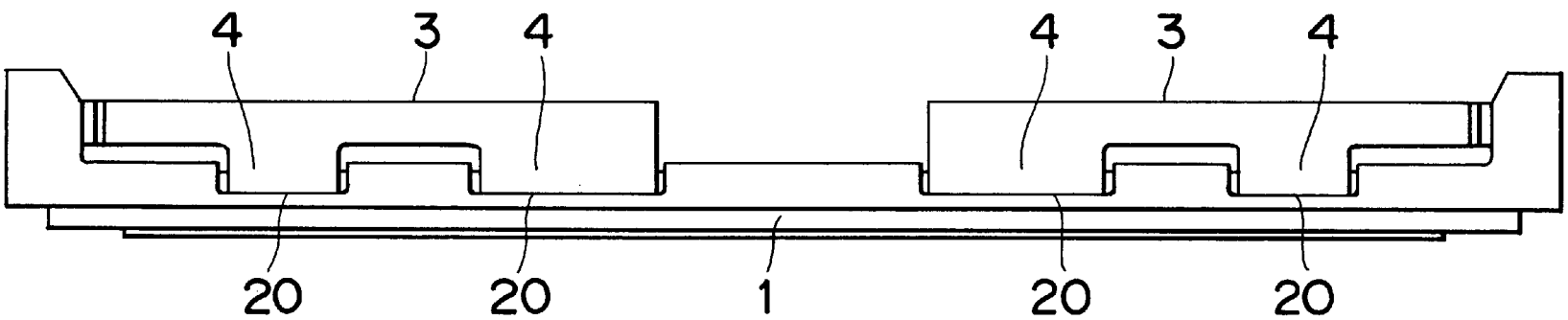

According to an embodiment shown in FIG. 7B, when the foldable container is folded, the supporting protrusions 4 are fitted into the concave portions 20 and the supporting protrusions 4 are kept into contact with the bottom of each of the concave portions 20 so that the side plates 3 fallen horizontally can be maintained in a stable condition.

Figure 12A:
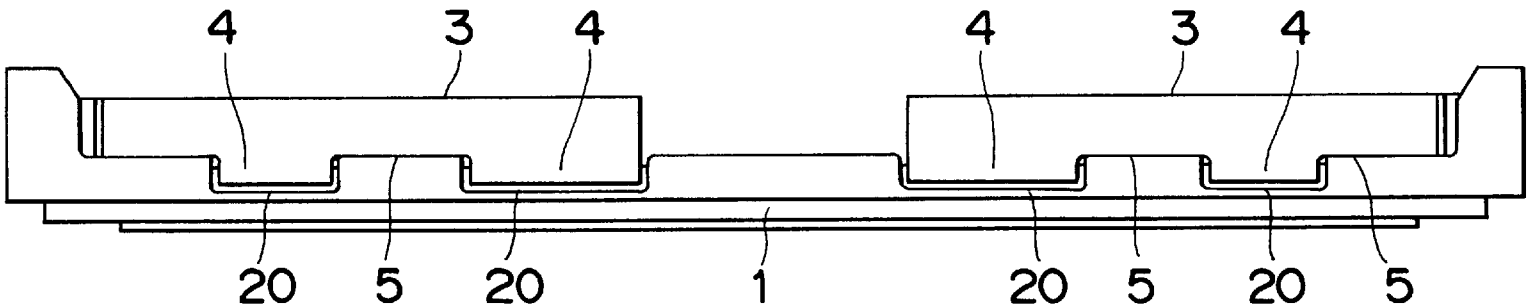
FIGS. 12A and 12B are side views showing a folded condition indicating other embodiments of the present invention.
Figure 12B:
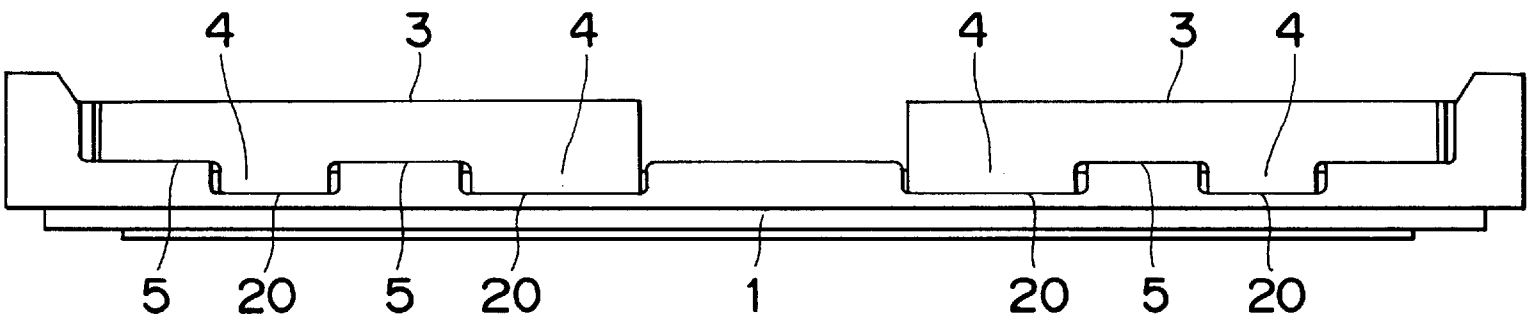

According to an embodiment shown in FIG. 12A, when the side plates 3 on the short side are fallen so that the supporting protrusions 4 on the both end portions are fitted into the concave portions 20 provided in both end portions corresponding to the long side of the bottom plate 1, a portion other than the portion on which the supporting protrusions 4 are provided on the both end portions of the side plate 3 on the short side is supported in contact with a supporting portion 5, which is another portion than the concave portions 20 in the both end portions corresponding to the long side of a top face of the bottom plate 1. Consequently, in the folded condition, a load applied to the side plate on the short side can be supported by other portion than the supporting protrusion 4, so that the folding state can be maintained in a stabilized condition. In this case, there are cases where the supporting protrusions 4 are kept in contact with the bottom of the concave portions 20 and where the supporting protrusions 4 are kept floating over the bottom of the concave portions 20. In case where the supporting protrusions 4 are kept in contact with the bottom of each of the concave portions 20 as shown in FIG. 12B, the condition that the side plates 3 on the short side are fallen can be maintained stable.

Figure 13:
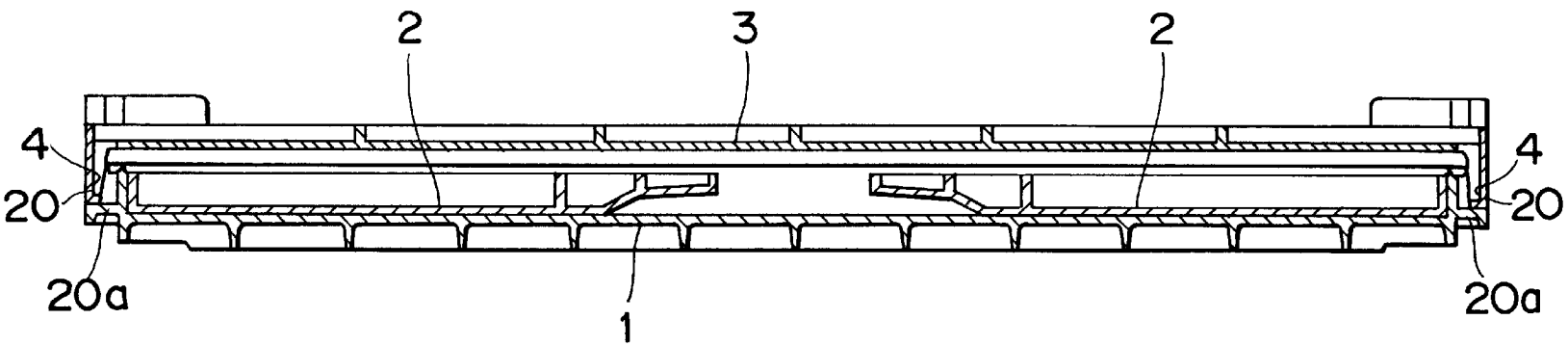
FIG. 13 is a sectional view of a portion in which supporting protrusions are fitted into concave portions according to another embodiment of the present invention.

According to an embodiment shown in FIG. 13, the concave portion 20 formed in a top face of the bottom plate 1 is open upward and outward. According to an embodiment shown in FIG. 13, the concave portion 20 is formed of a hole open upward and having a bottom 20*a*. If the concave portion 20 has the bottom 20*a*, the supporting protrusion 4 fitted in the concave portion 20 can be supported by the bottom 20*a* of the concave portion 20. Further, when the supporting protrusions 4 are fitted into the concave portions 20 formed of the holes open upward, the supporting protrusions 4 are not exposed on side faces of the foldable container when the container is folded. Consequently, the appearance is smart and the supporting protrusions 4 never collide with other object, so that the supporting protrusions 4 are difficult to damage.

Figure 14:
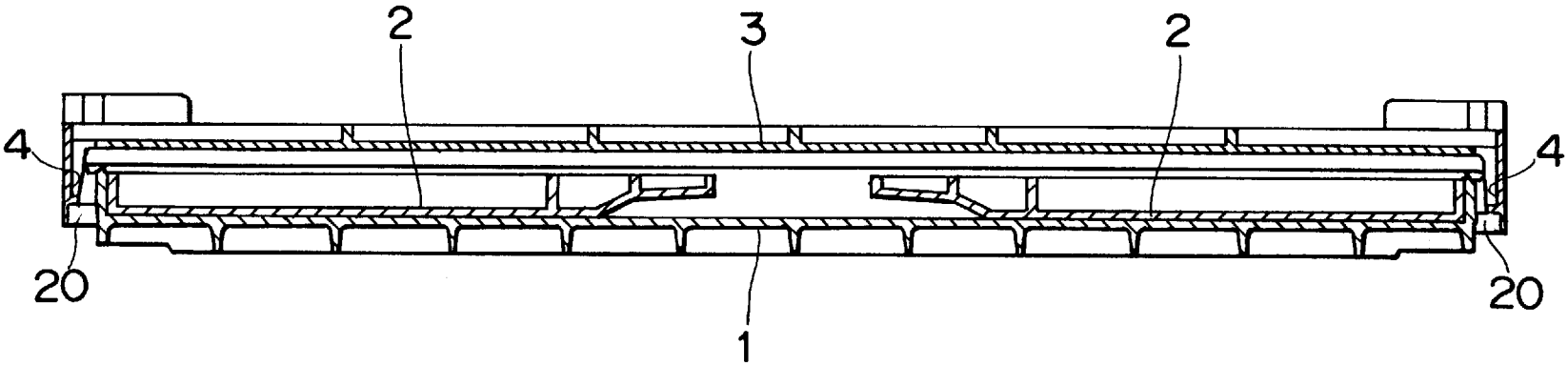
FIG. 14 is a sectional view of a portion in which supporting protrusions are fitted into concave portions according to another embodiment of the present invention.
Figure 15A:
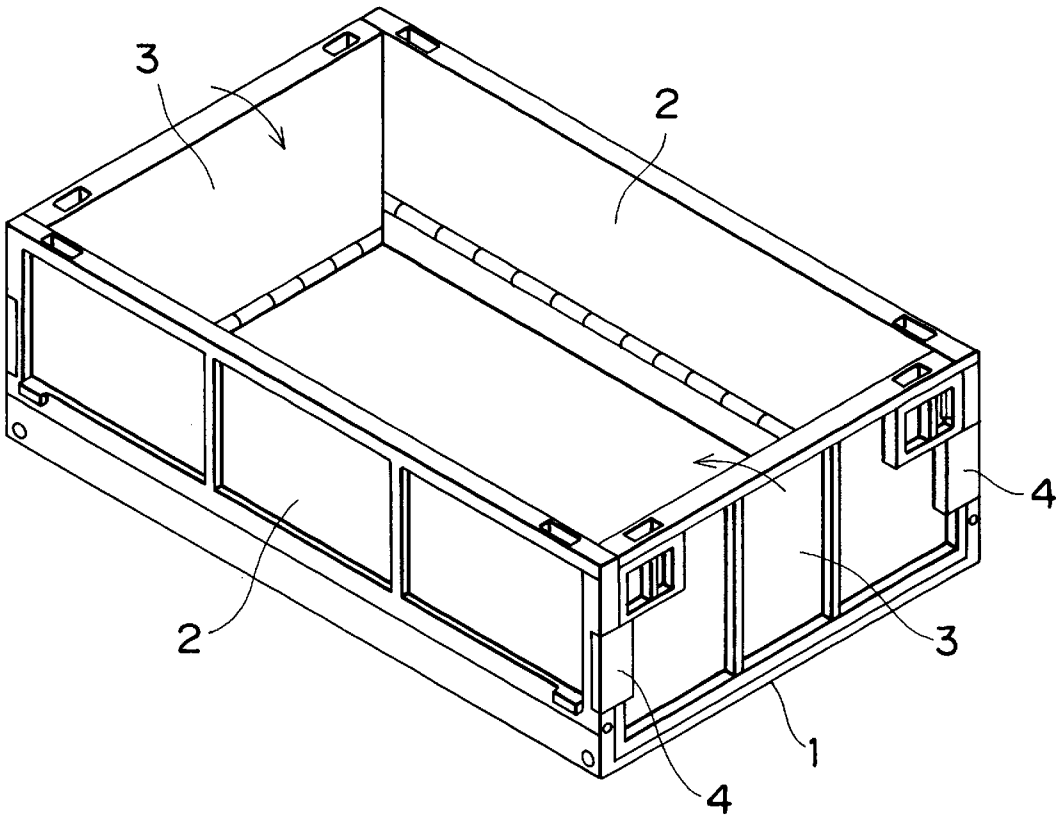
FIG. 15A RELATED ART
FIGS. 15A and 15B are a perspective view of a condition in which a conventional foldable container is assembled and a perspective view of a folded container.
Figure 15B:
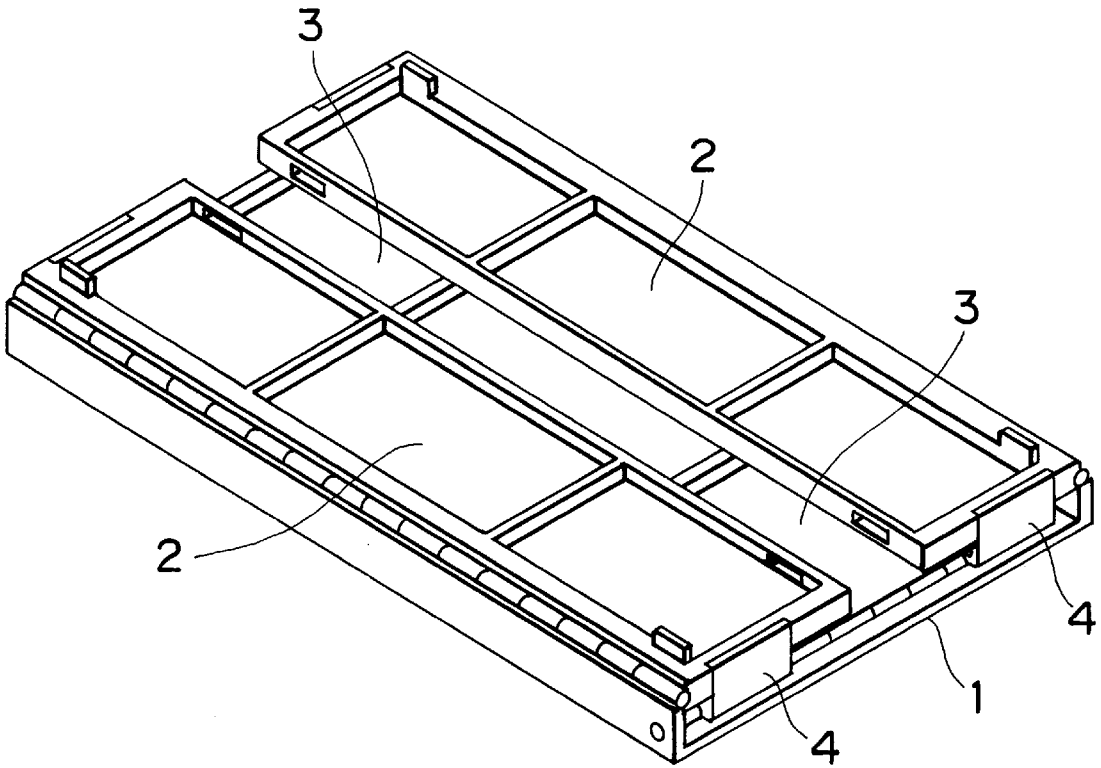
FIG. 15B RELATED ART

According to an embodiment shown in FIG. 14, the concave portions 20 are formed of holes open upward and downward. Provision of the concave portions, into which the supporting protrusions are fitted, are provided allows no water to be deposited in the concave portions 20 because the concave portions 20 are formed of holes open upward and downward. Further, by fitting the supporting protrusions 4 into the concave portions 20 formed of holes open upward and downward, the supporting protrusions 4 are not exposed on the side face of the foldable container when the supporting protrusions 4 are fitted into the concave portions 20. Consequently, the appearance is smart and the supporting protrusions 4 never collide with other object, so that the supporting protrusions 4 are difficult to damage.

According to the embodiments shown in FIGS. 1 to 12, the length of the side plate 2 corresponding to the long side in a direction at right angle to the long side of the bottom plate 1 is substantially no less than one-half the length of the short side of the bottom plate 1. As a result, when the container is folded by rotating the side plates, the side plates 2 on the long side in pairs partially overlap each other. Further, according to the embodiment shown in the same Figures, the length of the side plate 3 corresponding to the short side in a direction at right angle to the short side of the bottom plate 1 is shorter than substantially one-half the length of the long side of the bottom plate 1. As a result, when the container is folded by rotating the side plates, the side plates 3 on the short side in pairs do not overlap each other.

According to this embodiment, the height of the lateral shaft portion 9*a* is set as described below. When any one of the side plates 2 on the long side is fallen, the side plate 2 fallen first is inclined downward as it goes to its front end and part of the side plate 2 on the long side makes contact with a top face of the bottom plate. Next, when the other side plate 2 on the long side is fallen, the side plate 2 fallen later makes a face contact with the side plate 2 fallen first so that they overlap each other. Therefore, the height of the lateral shaft portion 9*a* which satisfies the above described condition differs depending on the thickness and length of the side plate 2 on the long side.

The height of the lateral shaft portion 9*b* is set as described below. That is, when the side plates 2 on the long side in pairs are folded so that the side plates 2 on the long side make a face contact with each other in an inclined condition, the side plates 3 on the short side in pairs can horizontally make contact with the inclined side plates 2 on the long side horizontally.

When folding the container assembled in the form of a box according to this embodiment, first, any one of the side plates 2 on the long side in pairs is fallen by rotating it and inclined so that part thereof makes contact with a top face of the bottom plate 1. Next, by rotating and falling the other side plate 2 on the long side, the other side plate 2 on the long side is brought into a contact with the inclined side plate 2 on the long side fallen first so that they overlap each other. In this case, when the side plates 2 on the long side in pairs are fallen, they overlap each other in parallel both in the longitudinal and lateral directions of the side plate 2.

That is, the side plates 2 on the long side in pairs make a face contact with each other when they are fallen. The face contact mentioned here is not limited to a case where the side plates make a face contact with each other so that they overlap each other. It also includes a case where a face formed on any one of the side plates contacts ribs formed longitudinally and laterally on the other side plate on the long side or ribs formed in the form of grid and a case where the ribs formed longitudinally and laterally on the side plate on the long side or ribs formed in the form of grid contact the ribs formed longitudinally and laterally or ribs formed in the form of grid on the other side plate. In any case, the side plates 2 on the long side in pairs overlap each other in parallel both in the longitudinal and lateral directions.

Figure 5A:
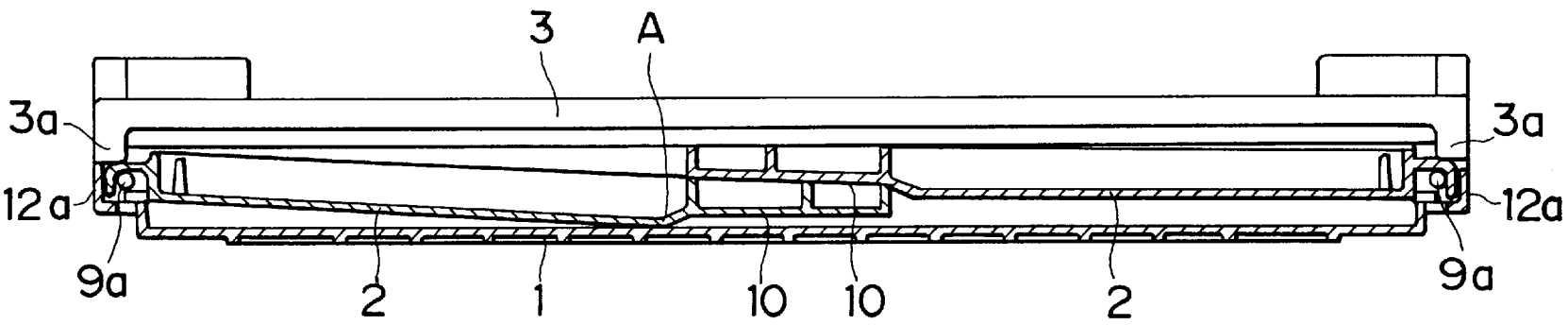
Figure 5B:
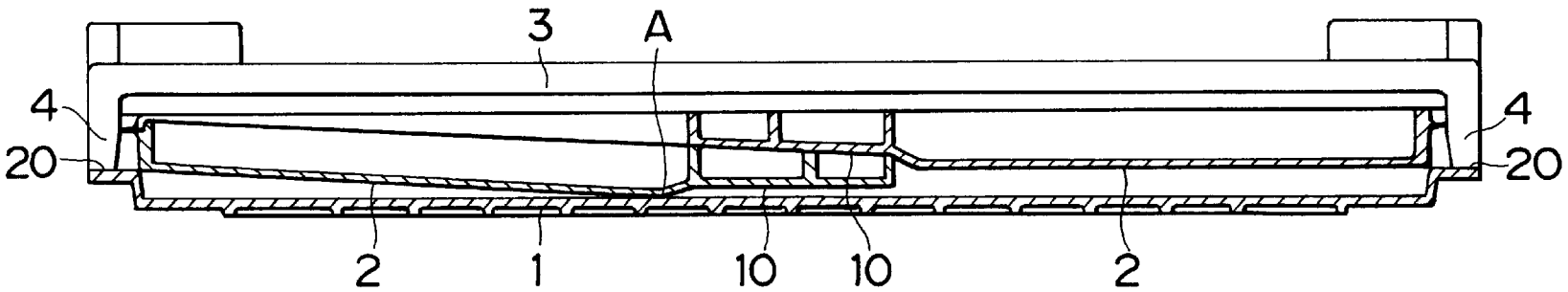

As a result, the side plates 2 on the long side in pairs having the journal position of the same height overlap each other such that part of the side plates 2 is inclined and the both side plates 2 are in parallel in the longitudinal and lateral directions as shown in FIG. 5. Because the container is folded such that the side plates 2 on the long side in pairs having the journal position of the same height overlap each other in parallel both in the longitudinal and lateral directions, the height of the overlaid side plates 2 when the length of the side plate 2 on the long side is not less than substantially one-half the length of the bottom plate 1 corresponding to the short side can be reduced. In the meantime, because the journal positions of the side plates 2 of the both sides are the same, the side plates 2 partially overlap each other in the face contact condition when they are folded and therefore, it is possible to eliminate any restriction in the folding order of the side plates 2 of the both sides.

Figure 6:
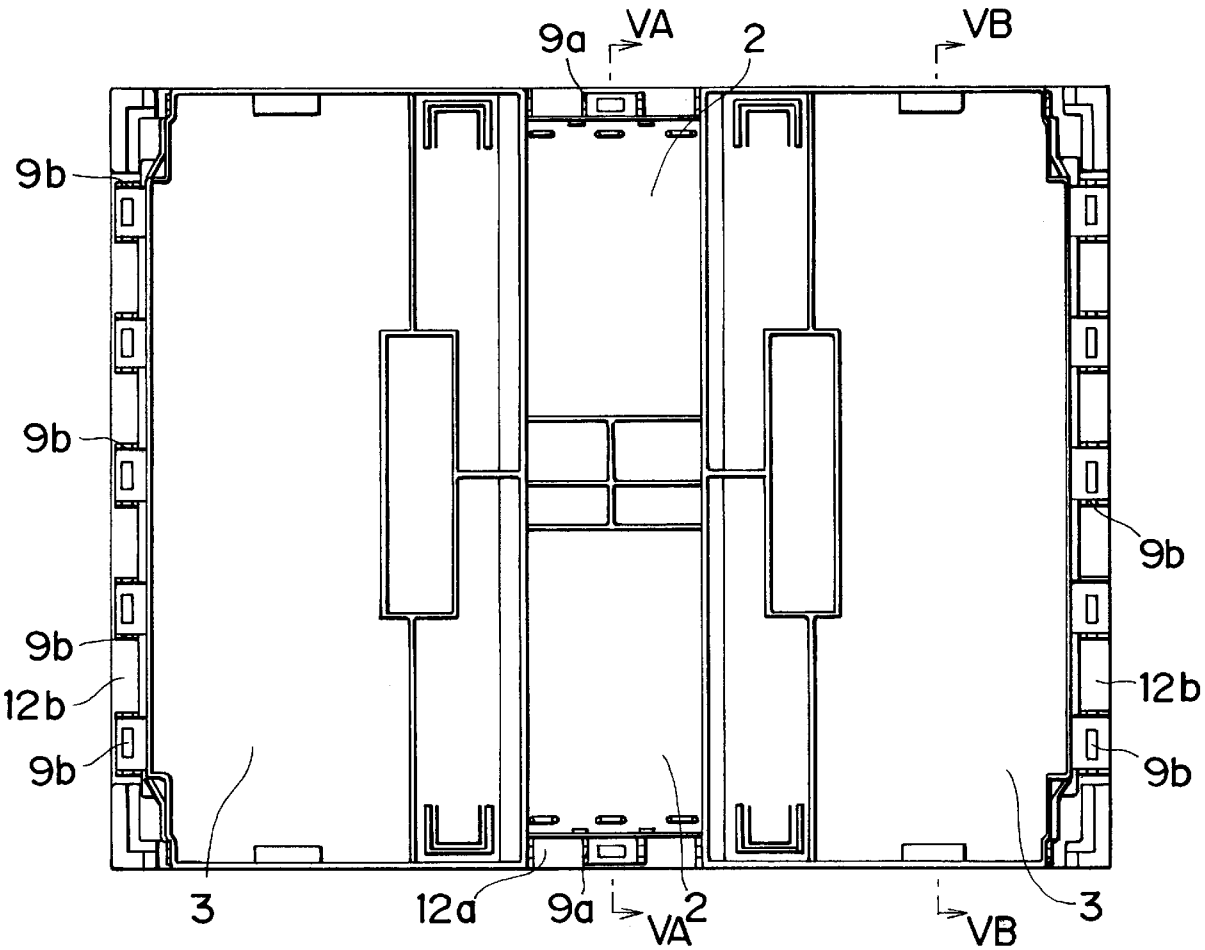
FIG. 6 is a plan view showing a condition in which the foldable container is folded.

After the side plates 2 on the long side in pairs are folded, the side plates 3 in pairs on the short side having the journal position of the same height are rotated and fallen, so that as shown in FIGS. 4, 5 and 6, the side plates 3 on the short side make contact with the uppre side plate 2 of the overlapping side plates 2 on the long side. Because the side plates 3 on the short side in pairs having the journal position of the same height make contact with the upper side plate 2 of the overlapping side plates 2 on the long side, the side plates 3 on the short side can be folded on the side plates 2 on the long side with as low as stacking height as possible.

Therefore, according to this embodiment, the stacking height can be reduced when the folded container is folded for the above reason so as to save space as much as possible for transportation or storage with the folded condition.

Figure 11:
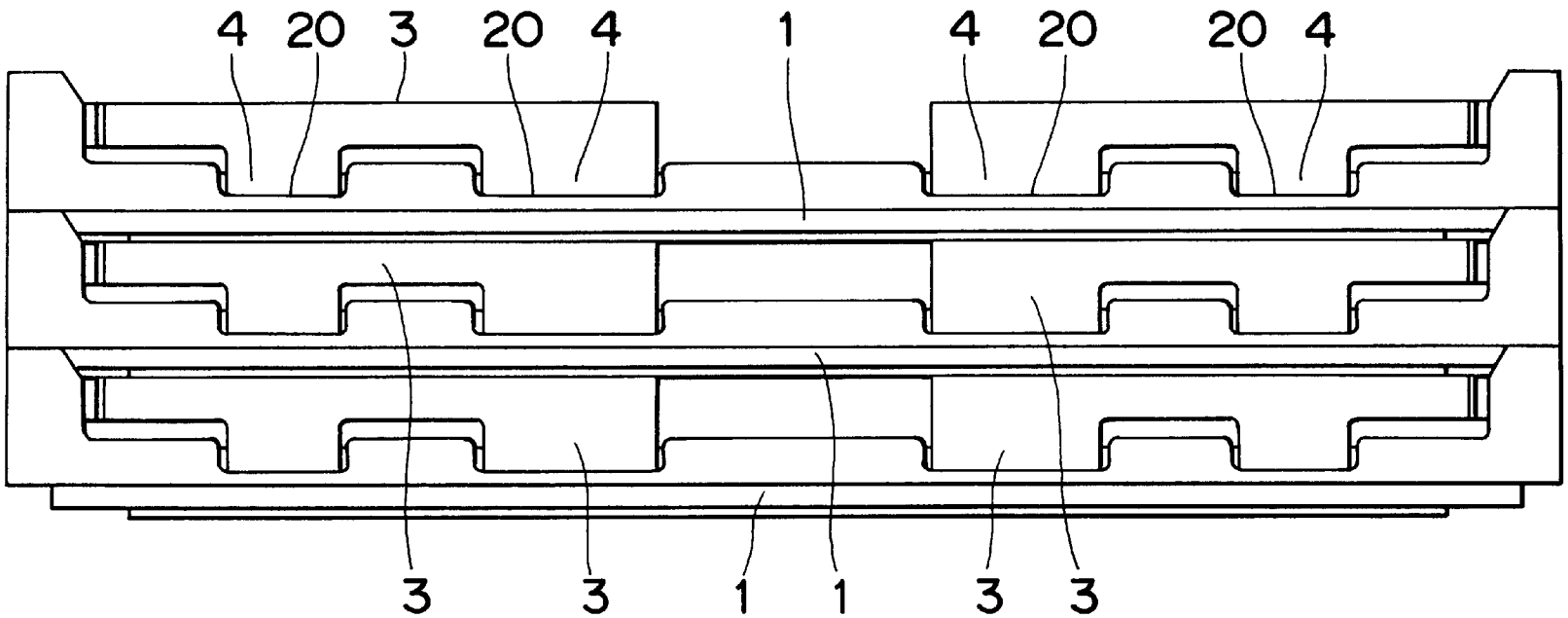
FIG. 11 is a front view showing a condition in which a plurality of the folded foldable containers are stacked vertically.

In the meantime, because the side plates 3 on the short side placed horizontally are located on the top face of the foldable container in the folded condition, the appearance thereof is excellent. FIG. 11 indicates a condition in which the foldable containers are stacked vertically.

Then, because, according to this embodiment, the length of the side plate 2 on the long side in a direction at right angle to the long side of the bottom plate 1 is not less than substantially one-half the length of the short side of the bottom plate 1, the height of the foldable container can be increased as compared to the conventional one when it is assembled, so that it can store a large number of storage objects. Further, because a highly stacked object can be stored such that it is not protruded out of an upper opening of the foldable container, there is not any problem even if the foldable containers are stacked vertically.

If a concave portion 10 is provided in a lower face when the end portion of the side plate 2 on the long side is fallen, a portion A deviated from the concave portion 10 toward the journal position in the side plate 2 on the long side makes contact with the top face of the bottom plate 1. Further, the concave portion 10 in the side plate 2 on the long side, located up when the side plate is fallen, makes a face contact with the top face of a front portion of the side plate 2 on the long side located down such that they overlap each other. That is, by forming the concave portions 10, it is possible to reduce the stacking height when the side plates 2 on the long side are fallen and overlaid.

In the meantime, the length of the side plate 3 on the short side in a direction at right angle to the short side of the bottom plate 1 may be longer than substantially one-half so that when the side plates 3 on the short side are folded, they overlap each other partially. In this case, the side plates 3 on the short side in pairs when they are fallen overlap each other in parallel both in the longitudinal and lateral directions. As a result, the height of the container when it is assembled can be increased, so that a larger number of the storage objects can be stored. Further, a more highly stacked storage object can be stored such that it is not protruded out of an upper opening of the container and there is no problem if the foldable containers are stacked vertically.

As shown in FIGS. 13 and 14, the length of the side plate 2 on the long side of the bottom plate 1 in a direction at right angle to the long side of the bottom plate 1 may be shorter than substantially one-half the length of the short side of the bottom plate 1. In this case, when the container is folded, the stacking height is smaller and when assembled, a shallow container is produced.

A foldable container within the spirit of the technology in which the both end portions on the inner face of the side plate 3 on the short side when raised support the side plates 2 on the long side that are opposed to each other through their both end faces as mentioned in the present invention can be applied to a foldable container in a square form as viewed in plan in which the lateral length of the side plate 3 on the short side substantially coincides with the lateral length of the side plate 2 on the long side.

What is claimed is:

1. A foldable container comprising:

a rectangular bottom plate;

side plates on the long sides of the bottom plate mounted rotatably on the long sides that are opposed to each other;

side plates on the short sides of the bottom plate mounted rotatably on the short sides that are opposed to each other, wherein the foldable container is folded by folding down a pair of the side plates on the short sides onto a pair of the side plates on the long sides previously folded down and the foldable container is assembled in the form of a box by raising the pair of the side plates on the short sides and then raising the pair of the side plates on the long sides;

at least one supporting protrusions provided on part of both side edges and extending from an inner face of the side plate on each short side, wherein each supporting protrusion of the at least one supporting protrusions supports an adjacent side edge of the adjacent side plate on the long side to prevent the side plates on each long side from falling outward;

a rising protruded portion on a side edge of each long side of the bottom plate;

at least one first concave portion provided in the rising protruded portion on each long side of the bottom plate;

a lateral shaft mounted in each first concave portion that rotatably mounts a corresponding side plate on the long sides; and at least one second concave portion provided in the rising protruded portion on each long side of the bottom plate to receive a corresponding supporting protrusion of the at least one supporting protrusions on the side plates on the short sides when folded down.

2. The foldable container according to claim 1, wherein each first and second concave portion is formed of a recess open upward and having a bottom.

3. The foldable container according to claim 1, wherein each first and second concave portion is formed of a recess open upward and downward.

4. A foldable container according to claim 1, wherein each supporting protrusion is supported by a corresponding second concave portion when the side plates on the short sides are folded down.

5. The foldable container according to claim 4, wherein each first and second concave portion is formed of a recess open upward and having a bottom.

6. The foldable container according to claim 4, wherein each first and second concave portion is formed of a recess open upward and downward.

7. A foldable container according to claim 1, wherein when the side plates on the short sides are folded down, a portion other than the at least one supporting protrusions on each side edge portions of the side plate is supported by both adjacent side edge of the side plates on the long sides of the bottom plate.

8. A foldable container according to claim 1, wherein only the side plates on the short sides have at least one of a hand held element and a hand operated element.

9. The foldable container according to claim 1, wherein when the side plates on the long sides are folded down, a first side plate on a long side has an inclination along an upper surface from an axis of rotation to a free edge and a second side plate on an opposing long side has a top surface substantially parallel to the bottom plate, the first side plate and second side plate have a free end portion extending along the free edge, such that the free end portions have a reduced thickness from a thickness of the side plates on the long sides, the free end portions overlapping one another at the reduced thickness when folded down.

10. The foldable container according to claim 9, wherein a line along a top surface of the first side plate, the line above and parallel to the axis of rotation of the first side plate, substantially defines with an upper surface of the second side plate when folded down, a plane that is parallel in longitudinal and lateral directions to the bottom plate.

11. The foldable container according to claim 1, wherein when the side plates on the short sides are folded down, the at least one supporting protrusion is totally received in a corresponding second concave portion and each side edge of each side plate on a short side rests on an opposing rising protruded portion.

12. A foldable container, comprising:

a rectangular bottom plate;

side plates on the long sides of the bottom plate mounted rotatably on the long sides that are opposed to each other;

side plates on the short sides of the bottom plate mounted rotatably on the short sides that are opposed to each other, wherein the foldable container is folded by folding down a pair of the side plates on the short sides onto a pair of the side plates on the long sides previously folded down and the foldable container is assembled in the form of a box by raising the pair of the side plates on the short sides and then raising the pair of the side plates on the long sides;

at least one supporting protrusions provided on part of both side edges and extending from an inner face of the side plate on each short side, wherein each supporting protrusion of the at least one supporting protrusion supports an adjacent side edge of the adjacent side plate on the long side to prevent the side plate on each long side from falling outward;

a rising protruded portion on a side edge of each long side of the bottom plate providing a lateral shaft portion for rotatably mounting a corresponding side plate on the long sides; and at least one second concave portion provided in the rising protruded portion on each long side of the bottom plate to receive a corresponding supporting protrusion of the at least one supporting protrusion on the side plates on the short sides when folded down, wherein a plane vertical to the bottom plate passes through the at least one supporting protrusion and an axis of the lateral shaft portion on each of the long sides.

13. A foldable container, comprising:

a rectangular bottom plate;

a first set of side plates on first sides of the bottom plate mounted rotatably on the first sides that are opposed to each other;

a second set of side plates on second sides of the bottom plate mounted rotatably on the second sides that are opposed to each other, wherein each set of the first and second sets of side plates comprises a pair of side plates and the foldable container is folded by folding down the pair of the side plates on the second sides onto the pair of the side plates on the first sides previously folded down and the foldable container is assembled in the form of a box by raising the pair of the side plates on the second sides and then raising the pair of the side plates on the first sides;

at least one supporting protrusion provided on part of each edge portion on an inner face of each side plate of the second set of side plates, wherein each supporting protrusion of the at least one supporting protrusion supports a side edge portion of an adjacent side plate of the first set of side plates when the second set of side plates is raised to prevent the first set of side plates from falling outward; and concave portions provided in edge portions along the first sides of the bottom plate in which the supporting protrusions are received when the second set of side plates are folded down, wherein when the first set of side plates are folded down, a first side plate of the first set of side plates has an inclination along an upper surface from an axis of rotation to a free edge and a second side plate of the first set of side plates has a top surface substantially parallel to the bottom plate, and wherein the first side plate of the first set of side plates and the second side plate of the first set of side plates have a free end portion extending along the free edge, such that the free end portions have a reduced thickness from a thickness of the first side plates to overlap one another at the reduced thickness.

14. The foldable container according to claim 13, wherein a line along a top surface of the first side plate of the first set of side plates, the line above and parallel to an axis of rotation of the first side plate, substantially defines with an upper surface of the second side plate of the first set of side plates, when folded down, a plane that is parallel in longitudinal and lateral directions to the bottom plate.

15. The foldable container according to claim 13, further comprising:

a first lateral shaft providing the rotatable mounting of the first side plate of the first set of side plates;

a second lateral shaft providing the rotatable mounting of the second side plate of the first set of side plates;

a third lateral shaft providing the rotatable mounting of a first side plate of the second set of side plates; and a fourth lateral shaft providing the rotatable mounting of a second side plate of the second set of side plates, wherein the second sides are short sides and the third lateral shaft and fourth lateral shaft are at a same height from a top surface of the bottom plate.

16. The foldable container according to claim 15, wherein the third lateral shaft and the fourth lateral shaft are higher than each of the first lateral shaft and second lateral shaft relative to the top surface of the bottom plate.

17. The foldable container according to claim 13, wherein when all side plates are folded down, a surface of each side plate of the second set of side plates toward the bottom plate is in contact with a surface away from the bottom plate of each side plate of the first set of side plates.

18. The foldable container according to claim 9, wherein the lateral shaft that rotatably mounts a corresponding side plate on the long side comprises:

a first lateral shaft providing the rotatable mounting of a side plate on one long side; and a second lateral shaft providing the rotatable mounting of a side plate on an opposite long side; the foldable container further comprising:

a third lateral shaft providing the rotatable mounting of a side plate of a short side; and a fourth lateral shaft providing the rotatable mounting of a side plate on an opposite short side, wherein the third lateral shaft and fourth lateral shaft are at a same height from a top surface of the bottom plate.

19. The foldable container according to claim 18, wherein the third lateral shaft and the fourth lateral shaft are higher than each of the first lateral shaft and second lateral shaft relative to the top surface of the bottom plate.

20. The foldable container according to claim 9, wherein when all side plates are folded down, a surface of each side plate on the short sides toward the bottom plate is in contact with a surface away from the bottom plate of each side plate on the long sides.

* * * * *